US011746630B2

(12) United States Patent
Head et al.

(10) Patent No.: US 11,746,630 B2
(45) Date of Patent: Sep. 5, 2023

(54) DEPLOYMENT OF A MODULAR ELECTRICALLY DRIVEN PUMP IN A WELL

(71) Applicant: Coreteq Systems Ltd., Camberley (GB)

(72) Inventors: Philip Head, Virginia Water (GB); Hassan Mansir, Maidenhead (GB)

(73) Assignee: CORETEQ SYSTEMS LTD., Camberley (GB)

( * ) Notice: Subject to any disclaimer, the term of this patent is extended or adjusted under 35 U.S.C. 154(b) by 590 days.

(21) Appl. No.: 16/066,426

(22) PCT Filed: Jan. 2, 2017

(86) PCT No.: PCT/GB2017/050001

§ 371 (c)(1),
(2) Date: Jun. 27, 2018

(87) PCT Pub. No.: WO2017/115094

PCT Pub. Date: Jul. 6, 2017

(65) Prior Publication Data

US 2019/0017357 A1 Jan. 17, 2019

(30) Foreign Application Priority Data

Dec. 27, 2015 (GB) ..... 1522999

(51) Int. Cl.
*E21B 43/12* (2006.01)
*E21B 17/02* (2006.01)
(Continued)

(52) U.S. Cl.
CPC ..... *E21B 43/128* (2013.01); *E21B 17/028* (2013.01); *F04D 13/10* (2013.01); *F04D 29/628* (2013.01)

(58) Field of Classification Search
CPC ..... E21B 43/128; E21B 17/02; E21B 17/028; F04D 13/08; F04D 13/086; F04D 13/10;
(Continued)

(56) References Cited

U.S. PATENT DOCUMENTS 3,835,929 A 9/1974 Suman, Jr.
3,939,705 A 2/1976 Glotin et al.
(Continued)

FOREIGN PATENT DOCUMENTS

EP 470576 A1 2/1992
EP 0745176 A1 12/1996
(Continued)

OTHER PUBLICATIONS

International Search Report and Written Opinion for PCT/GB2017/050001 dated May 17, 2017, 11 pages.

*Primary Examiner* — Bryan M Lettman
*Assistant Examiner* — Charles W Nichols
(74) *Attorney, Agent, or Firm* — Conley Rose, P.C.; Rodney B. Carroll

(57) ABSTRACT

An electric submersible pump system comprises an electric submersible pump body (50) having a first mating profile (53), an electric submersible pump motor (54) having a second mating profile (55), and an electrical wet connect point (61) at the top of the electric submersible pump. The electric submersible pump body (50) has a first mating drive shaft, and the electric submersible pump motor (54) has a second mating drive shaft, such that first and second mating drive shafts engage and can transmit torque from one drive shaft to the other.

18 Claims, 4 Drawing Sheets

(51) Int. Cl.
*F04D 13/10* (2006.01)
*F04D 29/62* (2006.01)

(58) Field of Classification Search
CPC ..... F04D 29/628; F04B 47/06; H01B 9/006; H01B 11/1834; H01B 11/1869
See application file for complete search history.

(56) References Cited

U.S. PATENT DOCUMENTS 4,105,279 A 8/1978 Glotin et al.
4,494,602 A 1/1985 Capdeboscq et al.
4,589,717 A 5/1986 Pottier et al.
4,798,247 A * 1/1989 Deaton ..... E21B 34/066 166/66.6
4,844,575 A * 7/1989 Kinard ..... G02B 6/4433 385/113
5,145,007 A * 9/1992 Dinkins ..... F04D 13/10 166/386
5,180,140 A 1/1993 Araki
5,191,173 A 3/1993 Sizer et al.
5,746,582 A 5/1998 Patterson
5,871,051 A 2/1999 Mann
6,213,202 B1 * 4/2001 Read, Jr. ..... E21B 17/06 166/55.1
6,398,583 B1 * 6/2002 Zehren ..... H01R 24/58 439/205
9,080,412 B2 * 7/2015 Wetzel ..... E21B 43/128
2002/0046869 A1 * 4/2002 Shimizu ..... H01B 7/0846 174/117 F
2006/0243450 A1 * 11/2006 Head ..... E21B 17/026 166/369
2013/0062050 A1 * 3/2013 Head ..... E21B 17/028 166/105
2014/0069074 A1 * 3/2014 Lauer ..... D07B 7/145 57/232

FOREIGN PATENT DOCUMENTS

WO 9522682 A1 8/1995
WO WO 98/22692 A1 5/1998
WO 2012045771 A2 4/2012

* cited by examiner

DEPLOYMENT OF A MODULAR ELECTRICALLY DRIVEN PUMP IN A WELL

CROSS-REFERENCE TO RELATED APPLICATIONS

This application is a National Stage Entry of PCT/GB2017/050001, and claims priority to, and the benefit of, Great Britain Patent Application No. GB 1522999.0, filed Dec. 27, 2015, the entirety of which is hereby incorporated by reference as if fully set forth herein.

TECHNICAL FIELD

This invention relates to a method of deploying a modular electrical submersible powered fluid transducer system, such as a gas compressor or an electrical submersible pump, generally known as an ESP, in an oil and/or gas production well.

BACKGROUND ART

The disposing in wells of electrical submersible systems has been done for many years using jointed tubular conduits with an electrical motor, and a fluid transducer connected to the bottom of the jointed tubing. Consecutive joints of tubular conduits are connected and lowered into a well with the assistance of a rig mast and hoisting equipment, whilst unspooling and connecting to the outer diameter of the tubing a continuous length of electrical power transmission cable. This method of disposing the electrical submersible fluid transducer system is well know to those familiar with the art of producing non-eruptive sources of oil and gas from the subterranean environment. The retrieval of these electrical submersible fluid transducer systems is also commonly accomplished by pulling the jointed tubing out of the well simultaneously with the electrical submersible motor and fluid transducer system and the electrical power transmission cable. The following prior art references are believed to be pertinent to the invention claimed in the present application: U.S. Pat. Nos. 3,939,705; 4,105,279; 4,494,602; 4,589,717; 5,180,140; 5,746,582 and 5,871,051; International patent application No. WO98/22692 and European patent specifications Nos. 470576 and 745176. U.S. Pat. Nos. 3,835,929, 5,180,140 and 5,191,173 teach the art of deploying and retrieving an electrical submersible system in oil wells using coiled or continuous tubing. These coiled tubing disposal methods often use large coiled tubing spool diameters owing to the radius of curvature possible of the continuous tubing. Hence the surface spooling devices that these systems require to inject and retrieve the continuous tubing are cumbersome, and require special surface and subterranean equipment for deployment and intervention.

Other previous art disclosed in the literature teaches the disposal and retrieval of the subterranean electrical fluid transducer system with wireline or wire rope as structural support for simultaneously disposing the electrical power transmission cable with the system. Hence these wireline methods and apparatus involve the use of large and unique surface intervention equipment to handle the weight and spool used for the electrical power cable and the wire rope to be run in the well. U.S. Pat. No. 5,746,582 discloses the retrieval of a submersible pumps whilst leaving an electrical motor and cable in a well. Hence the method of U.S. Pat. No. 5,746,582 teaches the retrieval and deployment of the mechanical portion of an electrical submersible fluid transmission system whilst leaving the electrical motor and other component parts of the electrical submersible system disposed in the disposal of the electrical motor separately from the electrical power transmission cable. In the case of artificially lifted wells powered with electrical submersible motor systems, the current art is to dispose the required transducer assembly, for example a pump or compressor assembly, with an electrical motor and electrical power cable simultaneously into the well with a supporting member. This supporting member is jointed tubing from a surface rig, a coiled tubing unit with continues tubing or braided cable. The tubing or a braided cable is required as the electrical power cable is not able to support its own weight in the well and hence must be connected and disposed in the well with a structural member for support. In the case of jointed pipe deployed from a rig, the power cable is attached to the electrical motor on surface, and the cable is attached to the tubing as the electrical motor, transducer, and tubing are disposed into the well casing or tubing. The attachment of the cable to the tube is done by the use of steel bands, cast clamps, and other methods known to those familiar with the oil and gas business. In other methods, the power cable is placed inside of continuous tubing or attached to the outside of continuous tubing with bands as taught by U.S. Pat. No. 5,191,173. This continuous tubing is often referred to in the industry as coiled tubing. U.S. Pat. No. 3,835,929 teaches the use of the continuous tubing with the electrical power transmission cable inside of the tube. In all cases where electrical submersible fluid transducers systems are disposed and retrieved from wells the electric motor and electrical power transmission cable are deployed or retrieved simultaneously.

It is well known to those familiar with electrical submersible power cable that the action of removing the cable from the well can result in damage to the electrical power transmission cable, in a variety of ways. The damage inflicted on the electrical power cable can be due to bending stresses imposed on the cable during the disposal and retrieval. The conventional electrical power cable insulation, wrapping, and shields can develop stress cracks from the spooling of the cable over sheaves and spools devices used to deploy the cable. Another failure mode associated with submersible power transmission cable is caused from impact loads or crushing of the cable as it is disposed or retrieved in the well. It is also well known that gases found in subterranean environments impregnated the permeability of the electrical power transmission cable's insulation, wrapping and shields. This gas is trapped in the permeability of the insulation at a pressure similar to the pressure found inside the well. When the cable is retrieved from the well the electrically powered transmission cable is exposed to ambient pressures. This will create a pressure differential between gas encapsulated in the cable insulation and the ambient surface pressure conditions. The rate of impregnated gas expansion from the higher pressure inside of the cable insulation expanding towards the lower pressure of the ambient conditions can sometimes exceed the cable insulation permeability's ability to equalize the pressure differential. The result is a void, or stressing of the insulation, and premature failure of the cable. The requirement to retrieve and dispose the electrical power transmission cable with the electrical submersible fluid traducer system also requires the use of specialised surface intervention equipment. This can require very large rigs, capable of pulling tubing, electrical power transmission cable, and electrical submersible fluid transducers. In the offshore environment these well intervention methods require semi-submersible drill ships and platforms. In the case of jointed conduit deployed in a plurality of threaded lengths, normally 9-12 m each, the pulling equipment is a drilling or pulling rig at surface. In the case that the electrical power transmission cable and assembly are disposed connected to or in continuous tubing, a specialised coiled tubing rig is required at surface. This coiled tubing unit consisting of an injector head, a hydraulic power unit, and a large diameter spooling device containing the continuous coiled tubing all located on the surface. This disposal and retrieval method requires significant space at the earth's surface or sea floor. The reasons for intervening in a well to retrieve or dispose an electrical submersible transducer system are well know to those familiar with the art of fluid removing fluids from wells. There are at least two classical reasons for intervention in wells disposed with electrical submersible fluid transducer systems. These include the need to increase fluid production, or the need to repair the disposed electrical submersible power system. The reason for requiring increased fluid production is dependent on many factors including but not limited to economical and reservoir management techniques discussed in the literature. The reasons for intervening for repair or to replace the electrical submersible fluid transducer systems are due to normal equipment wear and the subsequent loss of fluid production capacity, catastrophic equipment failure, and changes in the fluid production capacity of the subterranean fluid reservoir. The equipment failures can be caused due to subterranean electrical failures in the electrical motor windings, electrical motor insulation degradation due to heat or mechanical wear, conductive fluid leaking into the motor, wear or failure of the fluid transducer parts, wear of electrical motor bearings, shaft vibrations, changes in inflow performance of the reservoir, and other phenomena known to those familiar with the art of fluid production from wells. Therefore, it is often required to change out component parts of the electrical submersible fluid transducer system, but not necessarily the electrical power transmission cable. However, owing to prior art the power cable is retrieved when the electrical motor or the motor seals fail.

DISCLOSURE OF INVENTION

The primary object of the present invention is to provide a convenient system for deploying electric pumps downhole.

According to the present invention, there is provided a system for installing electric submersible pump with a electrical wet connector, then deploying the power cable separately with the other half of the electrical wet connector.

According to another aspect of the invention, the ESP assembly could include a sub surface safety valve, enabling the well to safely sealed in the event of some failure at or near surface.

According to another aspect of the invention the cable to deploy the ESP would only have to carry the weight of the ESP assembly. The cable incorporating the electrical conductors would only have to carry its own weight and that of the upper half of the electrical we connector.

According to another aspect of the invention, the power cable would have a strong tensile member designed to endure long life in a well, unlike conventional braided wireline.

BEST MODE FOR CARRYING OUT THE INVENTION

Figure 1:
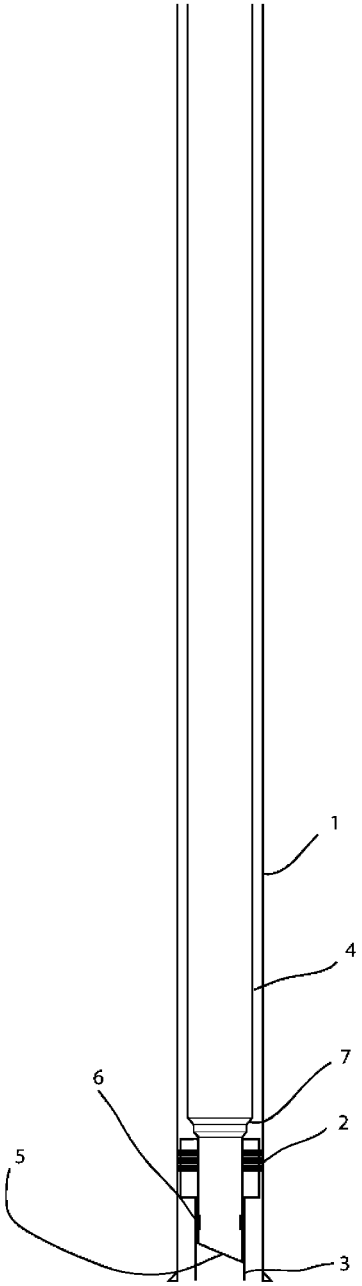
FIG. 1 shows a side view of an oil well, with production tubing with stinger tube, a packer set in the casing with a polished bore receptacle.
Figure 2:
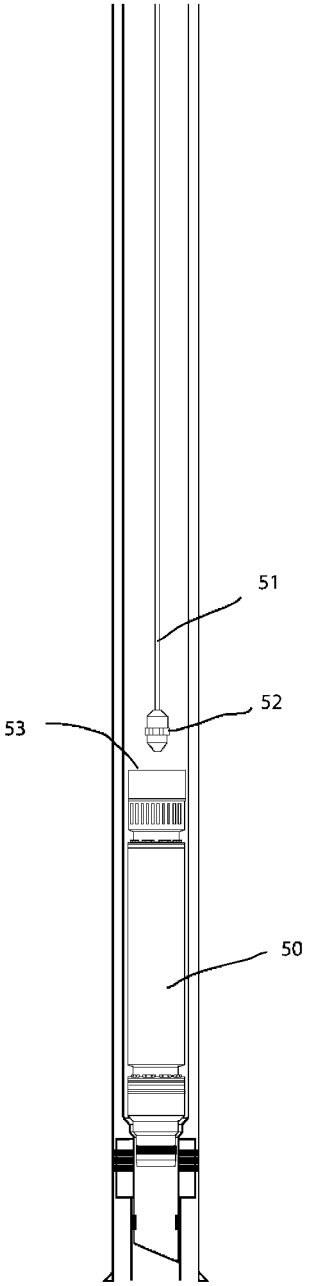
FIG. 2 shows a similar view to FIG. 1, with the pump section of the electrical submersible pump positioned in the lowermost part of the production tubing, the deployment cable disconnected.
Figure 3:
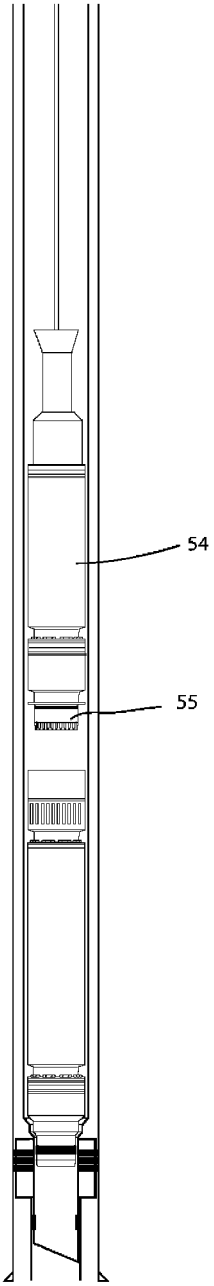
FIG. 3 shows a similar view to FIG. 2 with the motor section of an electrical submersible pump being lowered on a cable into the well
Figure 4:
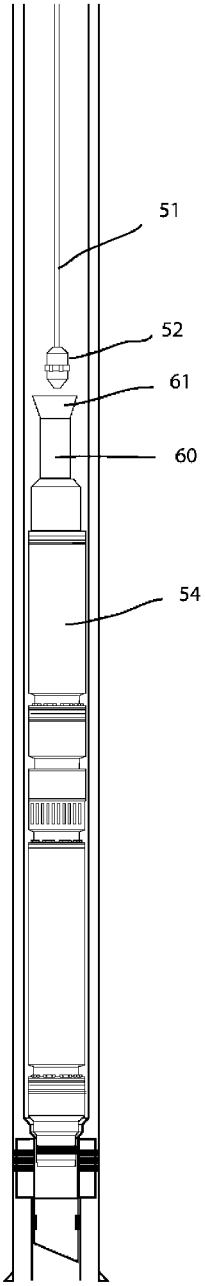
FIG. 4 shows a similar view to FIG. 3 with the electric motor docked to the pump and the deployment cable disconnected.
Figure 5:
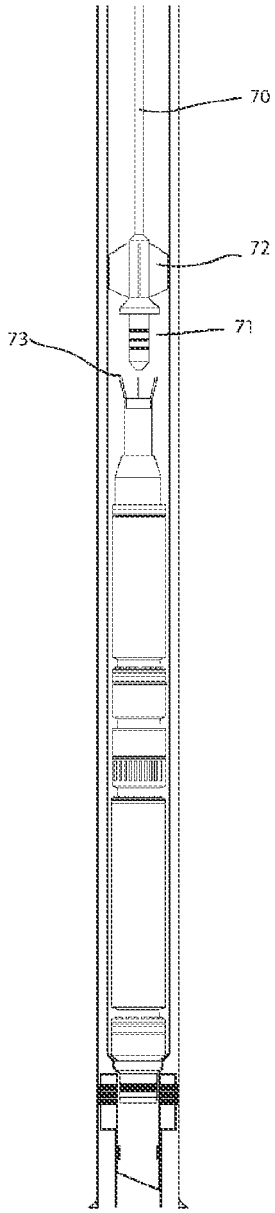
FIG. 5 shows a similar view to FIG. 4 with a power cable above the electrical submersible pump and the electrical wet connect termination on its lower most part about to be docked into the other half of the wet electrical connector which is at the top of the ESP assembly.
Figure 6:
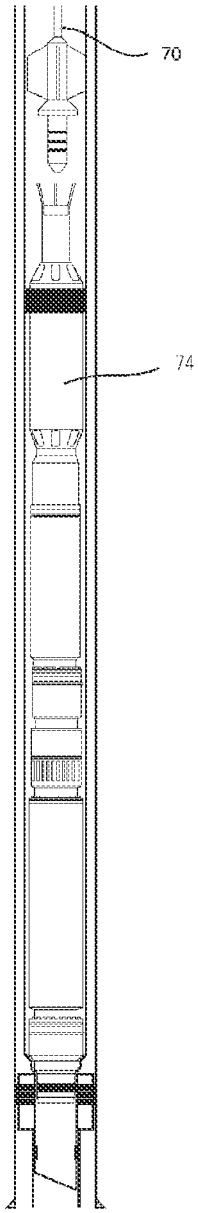
FIG. 6 is a similar view to FIG. 5, with the addition of a sub surface safety valve (SSSV) located between the electric motor and the lower half of the electrical wet connector.

Referring to FIGS. 1 to 6, there is shown a well completion with casing 1 cemented into the wellbore. A packer 2 is set in the casing which includes a polished bore receptacle (PBR) 3. The production tubing 4 stings into the PBR with a stinger 5 and seal 6. The production tubing includes other features which enable the electrical powered device to be installed and operated, these will now be described.

A no-go 7 landing shoulder feature is included to provide a reference stop point when installing the pump section 50 of the electrical submersible pump system. The pump section is lowered into the well on a strong cable 51 with a tool called a GS running tool 52 (available from Otis Engineering Corp). Inside the uppermost end of the pump is a splined drive for the pump, and lower mating unit 53.

The next module to be installed is the electric motor 54 which consists of the upper half of the mating unit 55, as the motor 54 engages with the pump 50, the lower half 53 and upper half 55 of the mating unit engage and lock the housings and the drive shafts together. Any suitable type of pump may be utilised in the lower half of the mating unit, for example an impeller pump.

At the upper end of the electric motor, is the lower half of the electrical wet connector 60. It is also lowered into the well on a strong cable 51 with a tool called a GS running tool 52. Inside the upper most end of the electric motor module 54 is a profile 62 in which the GS running tool is engaged.

Finally a power cable 70 is lowered in to the well terminated with the upper half of the three phase electrical wet connector 71, it also has centraliser fins 72 to keep it centralized in the production tubing 4. It is guided into the bore by a funnel arrangement 73 inside which is located the lower half of the 3 phase electrical wet connector 60. The benefit of this arrangement is the power cable 70 only has to support the weight of itself and the lower termination 71.

Figure 7:
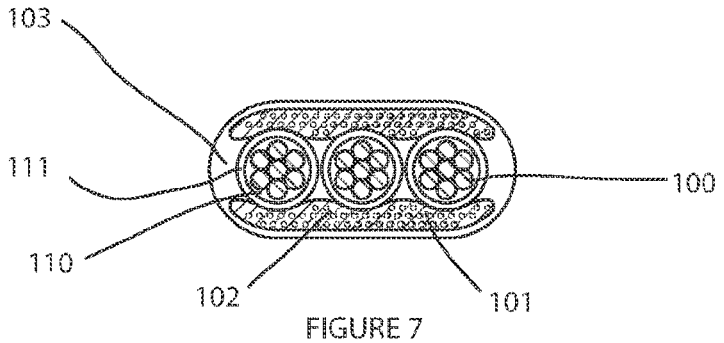
FIG. 7 is a cross section of one embodiment of the power cable
Figure 8:
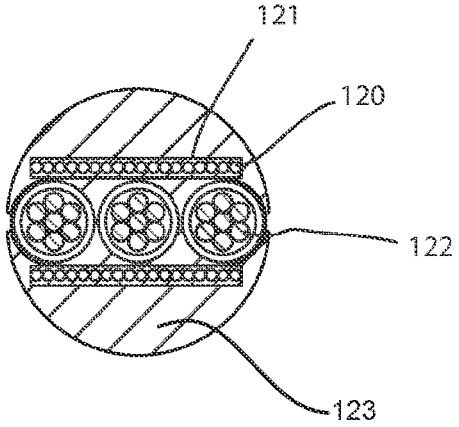
FIG. 8 is a cross section of another embodiment of the power cable
Figure 9:
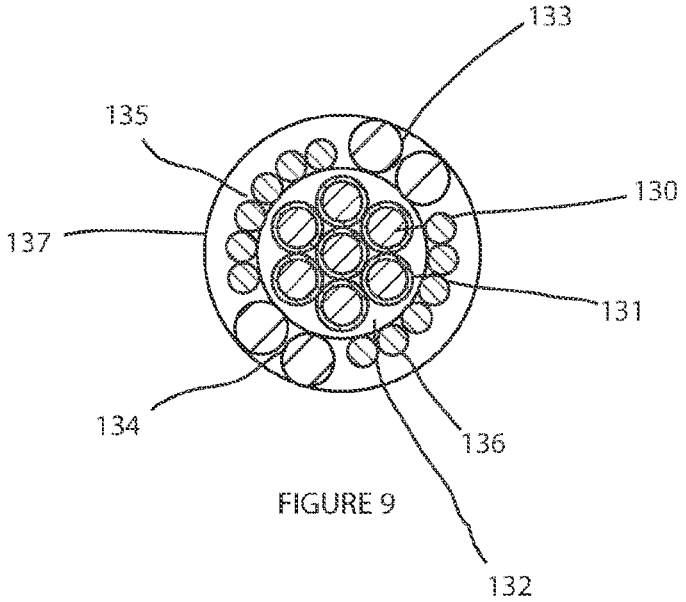
FIG. 9 is a cross section of a further embodiment of the power cable

In the situation where a sub-surface safety valve (SSSV) 73 is required, this would be fitted between the top of the motor and the bottom of the lower electrical wet connector, Referring to FIGS. 7 to 9 are various embodiments to the power cable.

These are designed to be very flexible in the horizontal axis, so that they can bend over the sheave wheels of a typical wire line surface rig.

The power cable 100 is multi stranded to again assist in flexibility and has a primary 110 and secondary 111 electrical insulation coatings. The power cables are sandwiched between two profiled tensile members 101, which are reinforced with polyester fibres, which are both lightweight and strong, They also protect the power cables from any side impacts or as they as the cable passes over the sheave wheels. An elastomer jacket 103 holds the assembly together.

An alternative tensile member is shown in FIG. 8. In this embodiment the tensile support members are made from high tensile strength steel stands 120 bonded in a flat jacket 121 to hold them together. Two of these are used to sandwich the power cables 122, an elastomer outer jacket 123 is used to hold the cable assembly together.

A further embodiment of the cable consists of a multi-stranded core 130 of copper clad steel, 131 which is insulated by a jacket 132. This performs two functions, supports the weight of the cable and provides one phase of the three phase supply. Around the outside of this core, is a second layer wound in the opposite helix to the inner core, this outer layer has two larger 133, 134 which perform three functions, the first is to be a reactive force to torque generated by the inner core, the second is to be proud of the electrical conductors 135, 136 to provide some mechanical protection and the third is to electrically separate the other two phases 135 and 136. The wire 135 and 136 are just copper. Finally a jacket 137 encapsulates the entire assembly.

The invention claimed is:

1. An electric submersible pump system, comprising:

an electric submersible pump body having a first mating profile;

an electric submersible pump motor having a second mating profile, the first mating profile of the electric submersible pump body corresponding to and engageable with the second mating profile of the electric submersible pump motor, the electric submersible pump motor being located above the electric submersible pump body;

a first electrical wet connector at a top of the electric submersible pump system comprising a funnel that is open upwards; and a cable terminating with a second electrical wet connector capable of docking with the first electrical wet connector to make an electrical connection in a wellbore, and comprising a first phase electrical conductor comprising a multi-stranded core insulated by a jacket, wherein each strand of the multi-stranded core comprises copper clad with steel, and where the multi-stranded core is wound in a helix in a first rotational direction;

a second phase electrical conductor disposed outside of the jacket of the first phase conductor, wherein the second phase electrical conductor comprises a plurality of wires;

a third phase electrical conductor disposed outside of the jacket of the first phase conductor, wherein the third phase electrical conductor comprises a plurality of wires;

a first mechanical protection wire disposed outside of the jacket of the first phase conductor;

a second mechanical protection wire disposed outside of the jacket of the first phase conductor on an opposite side of the jacket from the first mechanical protection wire, wherein the first mechanical protection wire separates the first phase electrical conductor and the second phase electrical conductor, wherein the second mechanical protection wire separates the first phase electrical conductor and the second phase electrical conductor on the opposite side of the jacket from the first mechanical protection wire, wherein the first mechanical protection wire and the second mechanical protection wire are proud of the second phase electrical conductor and of the third phase electrical conductor, and wherein the second phase electrical conductor, the third phase electrical conductor, the first mechanical protection wire, and the second mechanical protection wire are wound in a helix in a second rotational direction opposite of the first rotational direction; and an outer jacket that encapsulates the first phase electrical conductor, the second phase electrical conductor, the third phase electrical conductor, the first mechanical protection wire, and the second mechanical protection wire.

2. The electric submersible pump system according to claim 1, wherein the electric submersible pump body has a first mating drive shaft, and the electric submersible pump motor has a second mating drive shaft, such that the first mating drive shaft and the second mating drive shafts engage and can transmit torque from the first mating drive shaft to the second mating drive shaft.

3. The electric submersible pump system according to claim 1, further comprising a sub surface safety valve above the electric submersible pump system.

4. The electric submersible pump assembly of claim 1, wherein the cable comprises centralizer fins.

5. The electric submersible pump assembly of claim 1, wherein each strand of the multi-stranded core of the first phase electrical conductor is a tensile member.

6. The electric submersible pump assembly of claim 1, wherein the cable comprises a third mechanical protection wire disposed beside the first mechanical protection wire and outside of the jacket of the first phase conductor and a fourth mechanical protection wire disposed beside the second mechanical protection wire and outside the jacket of the first phase conductor and wherein the third mechanical protection wire and the fourth mechanical protection wire are encapsulated by the outer jacket.

7. The electric submersible pump assembly of claim 1, wherein the second phase electrical conductor comprises a plurality of copper wires and the third phase electrical conductor comprises a plurality of copper wires.

8. A length of downhole cable, comprising:

a plurality of conductors;

an electrical wet connector configured for docking with a mating electrical wet connector of an electrical motor to make an electrical connection in a wellbore;

a first phase electrical conductor comprising a multi-stranded core insulated by a jacket, wherein each strand of the multi-stranded core comprises copper clad with steel, and where the multi-stranded core is wound in a helix in a first rotational direction;

a second phase electrical conductor disposed outside of the jacket of the first phase conductor, wherein the second phase electrical conductor comprises a plurality of wires;

a third phase electrical conductor disposed outside of the jacket of the first phase conductor, wherein the third phase electrical conductor comprises a plurality of wires;

a first mechanical protection wire disposed outside of the jacket of the first phase conductor;

a second mechanical protection wire disposed outside of the jacket of the first phase conductor on an opposite side of the jacket from the first mechanical protection wire, wherein the first mechanical protection wire separates the first phase electrical conductor and the second phase electrical conductor, wherein the second mechanical protection wire separates the first phase electrical conductor and the second phase electrical conductor on the opposite side of the jacket from the first mechanical protection wire, wherein the first mechanical protection wire and the second mechanical protection wire are proud of the second phase electrical conductor and of the third phase electrical conductor, and wherein the second phase electrical conductor, the third phase electrical conductor, the first mechanical protection wire, and the second mechanical protection wire are wound in a helix in a second rotational direction opposite of the first rotational direction; and an outer jacket that encapsulates the first phase electrical conductor, the second phase electrical conductor, the third phase electrical conductor, the first mechanical protection wire, and the second mechanical protection wire.

9. The length of downhole cable of claim 8, wherein the cable comprises centralizer fins.

10. The length of downhole cable of claim 8, wherein each strand of the multi-stranded core of the first phase electrical conductor is a tensile member.

11. The length of downhole cable of claim 8, wherein the cable comprises a third mechanical protection wire disposed beside the first mechanical protection wire and outside of the jacket of the first phase conductor and a fourth mechanical protection wire disposed beside the second mechanical protection wire and outside the jacket of the first phase conductor and wherein the third mechanical protection wire and the fourth mechanical protection wire are encapsulated by the outer jacket.

12. The length of downhole cable of claim 8, wherein the second phase electrical conductor comprises a plurality of copper wires and the third phase electrical conductor comprises a plurality of copper wires.

13. A method for installing an electric submersible pump into a wellbore comprising:

deploying a pump section into the wellbore using a running tool connected to a cable;

deploying an electric motor into the wellbore using the running tool connected to the cable, wherein the electric motor comprises a first electrical wet connector at a top of the electric motor, and wherein the first electrical wet connector comprises a funnel that is open upwards;

deploying a power cable having a second wet connector into the wellbore, wherein the second electrical wet connector mates with the first electrical wet connector and wherein the power cable comprises a first phase electrical conductor comprising a multi-stranded core insulated by a jacket, wherein each strand of the multi-stranded core comprises copper clad with steel, and where the multi-stranded core is wound in a helix in a first rotational direction;

a second phase electrical conductor disposed outside of the jacket of the first phase conductor, wherein the second phase electrical conductor comprises a plurality of wires;

a third phase electrical conductor disposed outside of the jacket of the first phase conductor, wherein the third phase electrical conductor comprises a plurality of wires;

a first mechanical protection wire disposed outside of the jacket of the first phase conductor;

a second mechanical protection wire disposed outside of the jacket of the first phase conductor on an opposite side of the jacket from the first mechanical protection wire wherein the first mechanical protection wire separates the first phase electrical conductor and the second phase electrical conductor, wherein the second mechanical protection wire separates the first phase electrical conductor and the second phase electrical conductor on the opposite side of the jacket from the first mechanical protection wire, wherein the first mechanical protection wire and the second mechanical protection wire are proud of the second phase electrical conductor and of the third phase electrical conductor, and wherein the second phase electrical conductor, the third phase electrical conductor, the first mechanical protection wire, and the second mechanical protection wire are wound in a helix in a second rotational direction opposite of the first rotational direction; and an outer jacket that encapsulates the first phase electrical conductor, the second phase electrical conductor, the third phase electrical conductor, the first mechanical protection wire, and the mechanical protection wire.

14. The method of claim 13, wherein the cable comprises centralizer fins and further comprising centralizing the power cable by the centralizer fins within the wellbore as the power cable is deployed into the wellbore.

15. The method of claim 13, wherein each strand of the multi-stranded core of the first phase electrical conductor is a tensile member and further comprising supporting the weight of the cable by each strand of the multi-stranded core of the first phase electrical conductor.

16. The method of claim 13, wherein the cable comprises a third mechanical protection wire disposed beside the first mechanical protection wire and outside of the jacket of the first phase conductor and a fourth mechanical protection wire disposed beside the second mechanical protection wire and outside the jacket of the first phase conductor and wherein the third mechanical protection wire and the fourth mechanical protection wire are encapsulated by the outer jacket.

17. The method of claim 13, wherein the second phase electrical conductor comprises a plurality of copper wires and the third phase electrical conductor comprises a plurality of copper wires.

18. The method of claim 13, further comprising mechanically protecting the second phase electrical conductor and the third phase electrical conductor by the first mechanical protection wire and by the second mechanical protection wire.

* * * * *